US011849896B2

(12) United States Patent
Jiang et al.

(10) Patent No.: US 11,849,896 B2
(45) Date of Patent: Dec. 26, 2023

(54) CLEANING DEVICE FOR FLOOR MOPPING MACHINE

(71) Applicant: FORT PLASTIC & METALWORK (JIAXING) CO., LTD, Jiaxing (CN)

(72) Inventors: Tao Jiang, Jiaxing (CN); Xuan Li, Jiaxing (CN); Jing Li, Jiaxing (CN); Hao Chen, Jiaxing (CN); Hongwei Liu, Jiaxing (CN); Yongjian Zhang, Jiaxing (CN); Bin Wu, Jiaxing (CN)

(73) Assignee: FORT PLASTIC & METALWORK (JIAXING) CO., LTD, Jiaxing (CN)

( * ) Notice: Subject to any disclaimer, the term of this patent is extended or adjusted under 35 U.S.C. 154(b) by 0 days.

(21) Appl. No.: 17/789,232

(22) PCT Filed: Oct. 22, 2020

(86) PCT No.: PCT/CN2020/122771

§ 371 (c)(1),
(2) Date: Jun. 27, 2022

(87) PCT Pub. No.: WO2021/129091

PCT Pub. Date: Jul. 1, 2021

(65) Prior Publication Data

US 2023/0033868 A1 Feb. 2, 2023

(30) Foreign Application Priority Data

Dec. 27, 2019 (CN) ..... 201922418116.8
Dec. 27, 2019 (CN) ..... 201922418651.3
(Continued)

(51) Int. Cl.
*A47L 13/59* (2006.01)
*A47L 13/60* (2006.01)

(52) U.S. Cl.
CPC ..... *A47L 13/59* (2013.01); *A47L 13/60* (2013.01)

(58) Field of Classification Search
CPC ..... A47L 11/282; A47L 11/4016; A47L 11/4083; A47L 11/4091; A47L 13/59; A47L 13/60; A47L 2201/028
See application file for complete search history.

(56) References Cited

U.S. PATENT DOCUMENTS

2007/0039117 A1 2/2007 Palmer

FOREIGN PATENT DOCUMENTS

CN 207785091 U 8/2018
CN 108852212 A 11/2018
(Continued)

*Primary Examiner* — Randall E Chin
(74) *Attorney, Agent, or Firm* — Bayramoglu Law Offices LLC

(57) ABSTRACT

A cleaning device for a floor mopping machine comprises a bucket body for containing water, wherein a water removal member and a water feeding mechanism for conveying water from the bucket body to a wiping object of a floor mopping machine are arranged in the bucket body. During cleaning, the water feeding mechanism runs to convey water to the wiping object; and when water is removed, the water feeding mechanism stops running, and the wiping object of the floor mopping machine is wiped with the water removal member. Power of the water feeding mechanism is used for water feeding, and a wiping head is automatically cleaned, and can be wiped dry without any other operation after being cleaned; and the cleaning device is simple in structure, portable to use, less prone to damage and can be freely switched between a cleaning mode and a wipe-drying mode.

6 Claims, 13 Drawing Sheets

(30) Foreign Application Priority Data

| | | |
|---|---|---|
| Dec. 27, 2019 | (CN) | 201922425143.8 |
| Dec. 27, 2019 | (CN) | 201922443574.7 |
| Mar. 17, 2020 | (CN) | 202020331112.6 |
| Jun. 8, 2020 | (CN) | 202021039003.3 |

(56) References Cited

FOREIGN PATENT DOCUMENTS

| | | | | |
|---|---|---|---|---|
| CN | 109515394 | A | | 3/2019 |
| CN | 209269607 | U | | 8/2019 |
| JP | 2006-158814 | A | * | 6/2006 |
| WO | 2019056997 | A1 | | 3/2019 |
| WO | WO 2019/056997 | A1 | * | 3/2019 |

* cited by examiner

CLEANING DEVICE FOR FLOOR MOPPING MACHINE

CROSS-REFERENCE TO RELATED APPLICATIONS

This application is the national phase entry of a 371 application PCT/CN2020/122771 filed on Oct. 22, 2020 and is based upon and claims priority to Chinese Patent Applications No. 201922443574.7 filed on Dec. 27, 2019; No. 201922418116.8 filed on Dec. 27, 2019; No. 201922425143.8 filed on Dec. 27, 2019; No. 201922418651.3 filed on Dec. 27, 2019; No. 202021039003.3 filed on Jun. 8, 2020; and No. 202020331112.6 filed on Mar. 17, 2020, the entire contents of which are incorporated herein by reference.

TECHNICAL FIELD

The invention belongs to the technical field of accessories of floor mopping machines, and relates to a cleaning device for a floor mopping machine.

BACKGROUND

Mops are long-handled cleaning tools for cleaning floor. With the development of science and technology, automated mops with a mop head capable of moving automatically to mop floor are become more and more popular to users.

In the prior art, mop cleaning buckets with an automatic mop cleaning function can clean various mops, but such mop cleaning buckets are provided with a power mechanism, which makes these mop cleaning buckets heavy, inconvenient to use, complex in structure, and prone to damage; in addition, the mop cleaning buckets in the prior art have to be quickly switched between a cleaning mode and a wipe-drying mode, which makes the working efficiency low.

SUMMARY

The objective of the invention is to provide a cleaning device for a floor mopping machine to solve the above-mentioned problems.

To fulfill the above objective, the invention adopts the following technical solution:

A cleaning device for a floor mopping machine comprises a bucket body for containing water, wherein a water removal member and a water feeding mechanism for conveying water from the bucket body to a wiping object of a floor mopping machine are disposed in the bucket body;

During cleaning, the water feeding mechanism runs to convey water to the wiping object;

When water is removed, the water feeding mechanism stops running, and the wiping object of the floor mopping machine is wiped with the water removal member.

According to the cleaning device for a floor mopping machine, the water feeding mechanism is a water pump.

According to the cleaning device for a floor mopping machine, the water feeding mechanism comprises a roller rotatably connected to the bucket body, and when the roller rotates, cleaning water is conveyed to an object to be cleaned.

According to the cleaning device for a floor mopping machine, a clamping groove is formed in the bucket body, and an end of the roller is clamped in the clamping groove; when the roller rotates forward, the roller is clamped in the clamping groove and is stopped from rotating, so that the object to be cleaned can be wiped dry; and when the roller rotates reversely, cleaning water is conveyed to the object to be cleaned.

According to the cleaning device for a floor mopping machine, a limit step is disposed on a side, close to the center of the bucket body, of the clamping groove, and a plurality of clamping blocks are disposed at the end of the roller.

According to the cleaning device for a floor mopping machine, a top of the limit step can be clamped with the clamping blocks, and an oblique step is disposed at a bottom of the limit step; when the roller rotates reversely, the clamping blocks cooperate with the oblique step to enable the roller to move away from the limit step.

According to the cleaning device for a floor mopping machine, a wire is fixedly wound on the roller, and the other end of the wire is fixed to an inner wall of the bucket body; after the roller rotates forward by several circles, the wire is tensioned to stop the roller from rotating, and the object to be cleaned is wiped dry.

According to the cleaning device for a floor mopping machine, the wire is a coil spring; when the roller stops rotating forward, the roller is driven by the coil spring to rotate reversely to be restored.

According to the cleaning device for a floor mopping machine, a lifting base capable of ascending and descending in a vertical direction is disposed in the bucket body; and when the lifting base moves to a highest position, an end of the lifting base is matched with the roller, so that the roller is stopped from rotating and the object to be cleaned is wiped dry.

According to the cleaning device for a floor mopping machine, the bucket body comprises a dirty water cavity and a clean water cavity, and the water feeding mechanism conveys water from the clean water cavity to the wiping object of the floor mopping machine; and dirty water removed by the water removal member flows into the dirty water cavity.

According to the cleaning device for a floor mopping machine, the water removal member is any one or a combination of a strip, a brush and a roller.

Compared with the prior art, the invention has the following advantages: power of the water feeding mechanism is used for water feeding, the wiping object is automatically cleaned, and can be wiped dry without any other operation after being cleaned, and the cleaning device is simple in structure, portable to use, and less prone to damage; in addition, the cleaning device can be freely switched between a cleaning mode and a wipe-drying mode, operation is easy, ad working efficiency can be improved.

Other advantages, objectives and features of the invention will be partially reflected in the following description, and partially be understood by those skilled in the art in study and practice of the invention.

DETAILED DESCRIPTION OF THE EMBODIMENTS

Embodiment 1

Figure 1:
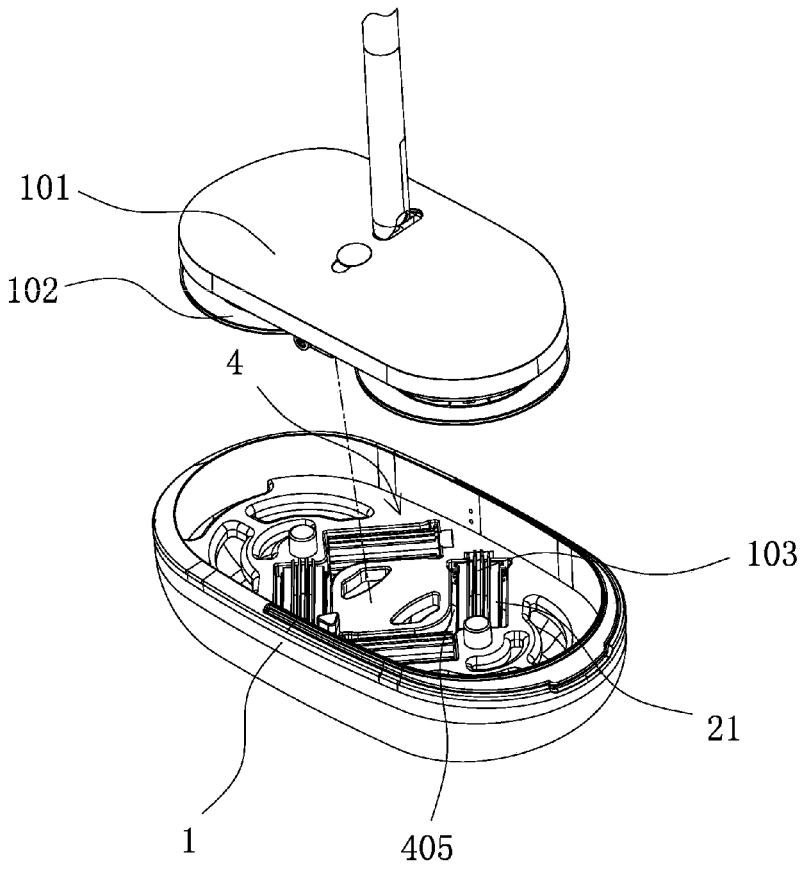
FIG. 1 is an exploded view of Embodiment 1.

As shown in FIG. 1-FIG. 8, a cleaning device for a floor mopping machine comprises a bucket body 1 for containing water, wherein a water removal member 4 and a water feeding mechanism 44 for conveying water from the bucket body 1 to a wiping object of a floor mopping machine are disposed in the bucket body 1.

During cleaning, the water feeding mechanism 44 runs to convey water to the wiping object; and when water is removed, the water feeding mechanism 44 stops running, and the wiping object of the floor mopping machine is wiped with the water removal member.

The floor mopping machine 101 is inserted into the bucket body 1, and the wiping object 102 capable of rotating in the circumferential direction is connected to the bottom of the floor mopping machine 101, and corresponds to strips 21.

In this embodiment, power of the water feeding mechanism is used for water feeding, the wiping object is automatically cleaned, and can be wiped dry without any other operation after being cleaned, and the cleaning device is simple in structure, portable to use, and less prone to damage; moreover, the cleaning device can be freely switched between a cleaning mode and a wipe-drying mode.

The water feeding mechanism 44 is a water pump.

The water feeding mechanism 44 comprises a plurality of rollers 103 rotatably connected to the bucket body 1; and when the rollers 103 rotate, cleaning water is conveyed to an object to be cleaned. In this embodiment, the wiping object, capable of rotating in the circumferential direction, of the floor mopping machine drives the rollers to rotate to feed water, so that the wiping object is automatically cleaned, and can be wiped dry without any other operation after being cleaned.

In this embodiment, as shown in FIG. 1-FIG. 8, when the rollers rotate, cleaning water is conveyed to an object to cleaned to clean the object; and when the rollers keep static, the object to be cleaned can be wiped dry.

The water removal member 4 is any one or a combination of a strip 21, a brush and a roller.

The water removal member 4 comprises a plurality of strips 21 or brushes, which are fixedly arranged on the bucket body 1.

Embodiment 2

Embodiment 2 is basically identical in structure and operating principle with Embodiment 1. Preferably, the water removal member 4 is a roller 103, the bucket body 1 is provided with a clamping groove 105, and an end of the roller 103 is inserted into the clamping groove 105; when rotating forward, the roller 103 is clamped in the clamping groove 105 to be stopped from rotating, so that an object to be cleaned can be wiped dry; and when the roller 103 rotates reversely, cleaning water can be conveyed to the object to be cleaned.

Figure 2:
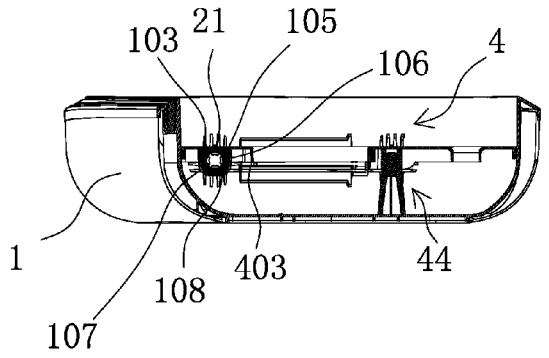
FIG. 2 is an internal structural view of Embodiment 2.

In this embodiment, as shown in FIG. 1 and FIG. 2, the floor mopping machine is inserted into the bucket body 1, and the wiping object 102 corresponds to the strip 21; when rotating forward, the roller 103 is clamped in the clamping groove 105 to be stopped from rotating, so that an object to be cleaned can be wiped dry; and when the roller 103 rotates reversely, cleaning water can be conveyed to the object to be cleaned.

A limit step 106 is disposed on a side, close to the center of the bucket body 1, of the clamping groove 105, and a plurality of clamping blocks 107 are disposed at the end of the roller 103.

In this embodiment, as shown in FIG. 1 and FIG. 2, when the wiping object 102 rotates forward, the limit step 106 cooperate with the clamping blocks 107 to stop the roller 103 from rotating; then, the wiping object continues to rotate to be wiped dry by the static strips 21 on the roller 103.

The top of the limit step 106 may be clamped with the clamping blocks 107, and an oblique step 108 is disposed at the bottom of the limit step 106; and when the roller 103 rotates reversely, the clamping blocks 107 cooperate with the oblique step 108 to enable the roller 103 to move away from the limit step 106.

In this embodiment, as shown in FIG. 1 and FIG. 2, when the wiping object 102 drives the roller 103 to rotate forward, a force is applied to the roller 103 to drive the roller 103 to move horizontally towards the limit step 106, so that the clamping blocks are clamped with the limit step 106; and when the wiping object 102 drives the roller 103 to rotate reversely, a force is applied to the roller 103 to drive the roller 103 to move horizontally away from the limit step 106, so that the clamping blocks are separated from the oblique step 108, and thus, the clamping blocks will not collide with the oblique step during water feeding, which may otherwise generate noise.

The operating principle of Embodiment 2 is as follows: the floor mopping machine is inserted into the bucket body 1, and the wiping object 102 corresponds to the strips 21; when the wiping object 102 drives the roller 103 to rotate reversely, a force is applied to the roller 103 to driver the roller 103 to move horizontally away from the limit step 106 to separate the clamping blocks from the oblique step 108, so that the clamping block will not collide with the oblique step during water feeding and noise is avoided, and the roller 103 can be driven to rotate to convey cleaning water from the bottom of the bucket body 1 to the wiping object through the strips 21 so as to clean the wiping object; and when the wiping object 102 drives the roller 103 to rotate forward, a force is applied to the roller 103 to drive the roller 103 to move horizontally towards the limit step 106 to make the clamping blocks clamped with the limit step 106, so that the roller 103 is stopped from rotating to stop water feeding, and the wiping object continues to rotate to be wiped dry by the strips 21 on the roller 103.

Embodiment 3

Embodiment 3 is basically identical in structure and operating principle with Embodiment 1. Preferably, the water removal member 4 is a roller 103, a wire 109 is fixedly wound on the roller 103, and the other end of the wire 109 is fixed to an inner wall of the bucket body 1; and after the roller 103 rotates forward by several circles, the wire 109 will be tensioned to stop the roller 103 from rotating, and an object to be cleaned can be wiped dry.

Figure 3:
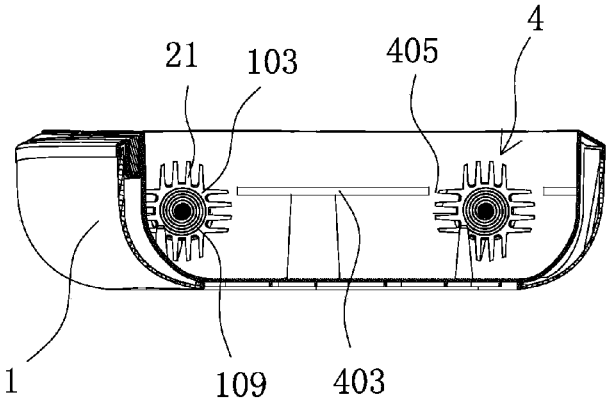
FIG. 3 is an internal structural view of Embodiment 3 when a coil spring is in a released state.
Figure 4:
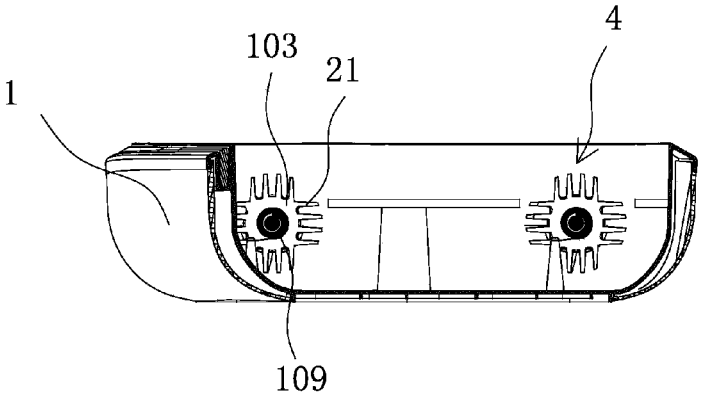
FIG. 4 is an internal structural view of Embodiment 3 when the coil springs is in a tightened state.

In this embodiment, as shown in FIG. 3 and FIG. 4, the floor mopping machine is inserted into the bucket body 1, and the wiping object 102 corresponds to the stripes 21; after the roller 103 rotates forward by several circles, the wire 109 will be tensioned to stop the roller 103 from rotating, and an object to be cleaned can be wiped dry.

The wire 109 is a coil spring; and when the roller 103 stops rotating forward, the coil spring drives the roller 103 to rotate reversely to be restored.

In this embodiment, as shown in FIG. 3 and FIG. 4, after cleaning, the roller can be automatically restored by the coil spring so as to be used next time.

The operating principle of Embodiment 3 is as follows: the floor mopping machine is inserted into the bucket body 1, and the wiping object 102 corresponds to the strips 21; when the wiping object rotates clockwise in the circumferential direction, the roller 103 is driven to rotate to convey cleaning water from the bottom of the bucket body 1 to the wiping object through the strips 21 so as to clean the wiping object; after the roller 103 rotates for several circles, the wire 109 stops the roller 103 from rotating to stop water feeding, the wiping object continues to rotate to be wiped dry by the strips 21 on the roller 103; and when the wiping object stops rotating, the roller 103 is driven by the wire 109 to be restored without manual operation, so as to be used next time.

Embodiment 4

Embodiment 4 is basically identical in structure and operating principle with Embodiment 1. Preferably, the water removal member 4 is a roller 103, and a lifting base 310 capable of ascending and descending in the vertical direction is disposed in the bucket body 1; and when the lifting base 310 moves to a highest position, an end of the lifting base 310 is clamped with the strips 21 on the roller 103, so that the roller 103 is stopped from rotating, and an object to be cleaned can be wiped dry.

The water removal member 4 further comprises a locking mechanism for locking or unlocking the lifting base 310, strips 21 are disposed on the roller 103, the locking mechanism comprises a limit post 601 disposed at the bottom of the bucket body 1, a limit slot 602 is formed in the limit post 601, and the bottom of the lifting base 310 is inserted into the limit slot 602 and is able to reciprocate in the limit slot 601 in the vertical direction.

Figure 5:
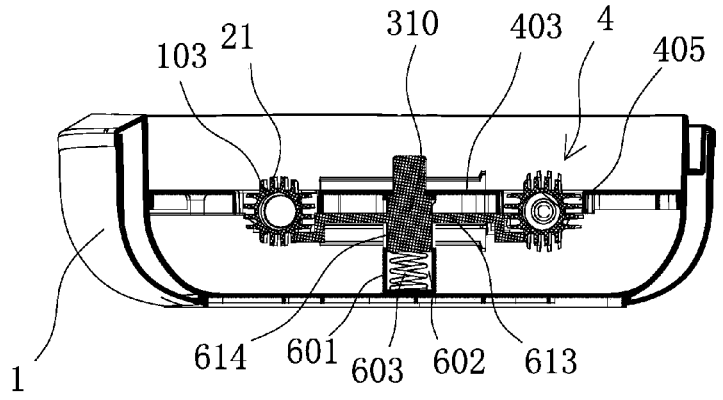
FIG. 5 is an internal structural view of Embodiment 4 when a roller is locked.
Figure 6:
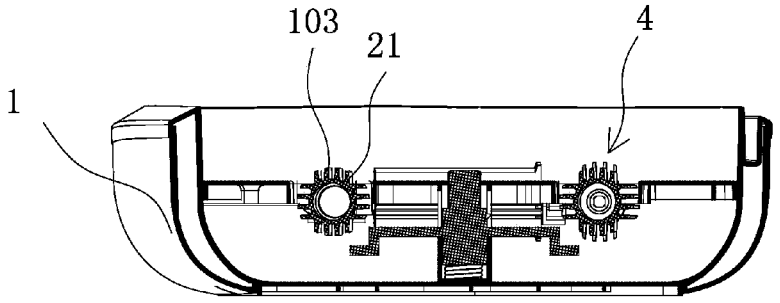
FIG. 6 is an internal structural view of Embodiment 4 when the roller is released.
Figure 7:
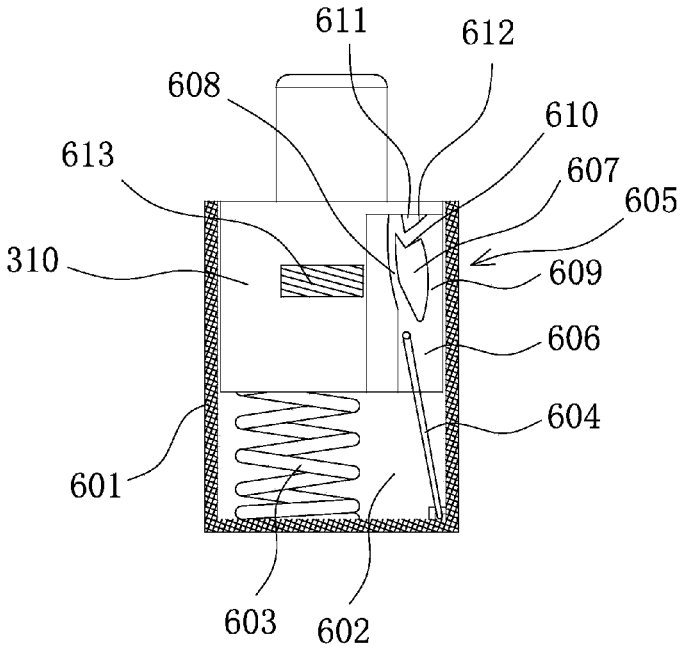
FIG. 7 is an internal structural view of a lifting base in Embodiment 4.

In this embodiment, as shown in FIG. 5, FIG. 6 and FIG. 7, the lifting base 310 can be limited in the limit slot 602 to be prevented from deviating in the moving process.

A reset spring 603 is connected to the bottom of the lifting base 310, and an end, away from the lifting base 310, of the reset spring 603 is fixed to the bottom of the limit slot 602.

In this embodiment, as shown in FIG. 5, FIG. 6 and FIG. 7, the reset spring 603 can drive the lifting base 310 to be restored.

A rotatable hook 604 is disposed at the bottom of the limit slot 602, the hook 604 is sloping and has an end inserted into the lifting base 310, and a lock assembly 605 matched with the hook 604 is disposed in the lifting base 310.

In this embodiment, as shown in FIG. 5, FIG. 6 and FIG. 7, when the lifting base 310 is separated from the roller, the hook 604 cooperates with the lock assembly 605 to lock the lifting base 310 to prevent the lifting base 310 from being restored by the reset spring 603 when the wiping object is cleaned, which may otherwise cause a failure of water feeding.

The lock assembly 605 comprises a lock slot 606 formed in the lifting base 310, the hook 604 604 is inserted into the lock slot 606 and clings to a side wall of the lock slot 606, a plug 607 is disposed in the lock slot 606, an entry slot 608 is formed in a left side of the plug 607, a lock slot 610 is formed in the top of the plug 607, and an end of the hook 604 points to the entry slot 608.

In this embodiment, as shown in FIG. 5, FIG. 6 and FIG. 7, when the roller is locked by the lifting base 310, the lifting base 310 is pressed downwards to enable the hook 604 to slide into the entry slot 608 along the side wall of the lock slot 606; when the lifting base 310 is released, the spring drives the lifting base 310 to move upwards to allow the hook 604 to slide into the lock slot 610, at this moment, the hook 604 cooperates with the lock slot 610 to prevent the lifting base 310 from being restored and keep the lifting base 310 separated from the roller.

A disengaging groove 609 is formed in a right side of the plug 607, a disengaging block 611 is disposed at the top of the plug 607, and a disengaging step 612 is disposed at the bottom of the disengaging block 611.

In this embodiment, as shown in FIG. 5, FIG. 6 and FIG. 7, when the hook 604 is located in the lock slot 610, the lifting base 310 is pressed downwards to drives the disengaging block 611 to move downwards, and the hook 604 to slide into the disengaging groove 609 through the disengaging step 612 at the bottom of the disengaging block 611; and when the lifting base 310 is released, the spring drives the lifting base 310 to move upwards, and the hook 604 slides out of the disengaging groove 609.

A support seat 403 is disposed in the bucket body 1. The clamping groove 105 is formed in the support seat 403, and the support seat 403 is provided with a plurality of water supply channels 405, which are in one-to-one correspondence with roller 103 and penetrate through the support seat 403, and the rollers 103 are located in the water supply channels 405.

In this embodiment, as shown in FIG. 5, FIG. 6 and FIG. 7, the support seat 403 can support the floor mopping machine to make the wiping object better match the rollers 103; and when the roller 103 rotates, cleaning water is conveyed to the wiping object through the water supply channels 405, so as to clean the wiping object.

The support seat 403 is higher than the surface of cleaning water at the bottom of the bucket body 1, and the bottom of the roller 103 is immersed in the cleaning water.

In this embodiment, as shown in FIG. 4, FIG. 6 and FIG. 7, the support seat 403 is higher than the surface of the cleaning water at the bottom of the bucket body 1, so that the wiping object is protected from being polluted by dirty water in the bucket body after being cleaned.

The strips 21 are obliquely disposed on the roller 103 and are distributed in a ring array around the center point of the roller 103, and the strips 21 located at the bottom of the roller 103 are immersed in the cleaning water.

In this embodiment, as shown in FIG. 5, FIG. 6 and FIG. 7, the strips 21 are obliquely disposed on the roller 103, so that more water can be supplied during water feeding, thus improving the cleaning efficiency; and the strips 21 at the bottom of the roller 103 are immersed in the cleaning water, so that clean water below the roller 103 can be conveyed onto the wiping object in the water feeding and cleaning process.

A lock arm 613 matching the strips 21 is connected to a side wall of the lifting base 310, a lock arm slot 614 corresponding to the lock arm 613 is formed in a side wall of the limit post 601, and the lock arm 613 penetrates through the lock arm slot 614 and is able to reciprocate linearly in the lock arm slot 614.

In this embodiment, as shown in FIG. 5, FIG. 6 and FIG. 7, the lock arm 613 cooperates with the strips 21 to lock the roller 103.

The operating principle of Embodiment 4 is as follows: when the roller is locked by the lifting base 310, the lifting base 310 is pressed downwards, and the hook 604 slides into the entry slot 608 along the side wall of the lock slot 606; when the lifting base 310 is released, the spring drives the lifting base 310 to move upwards to allow the hook 604 to slide into the lock slot 610, at this moment, the hook 604 cooperates with the lock slot 610 to prevent the lifting base 310 from being restored and keep the lifting base 310 separated from the roller, and the wiping object 102 rotates to drive the roller 103 to rotate, so that the wiping object is cleaned; when the hook 604 is located in the lock slot 610, the lifting base 310 is pressed downwards to drive the disengaging block 611 to move downwards, and the hook 610 slides into the disengaging slot 609 through the disengaging step 612 at the bottom of the disengaging block 611; when the lifting base 310 is released, the spring drives the lifting base 310 to move upwards, the hook 604 slides out of the disengaging slot 609, the roller 103 is locked by the lifting base 310, and the wiping object 102 rotates to be wiped dry by the static strips 21 on the roller 103.

The bucket body 1 comprises a dirty water cavity and a clean water cavity, and the water feeding mechanism 44 conveys water from the clean water cavity to the wiping object of the floor mopping machine; and dirty water removed by the water removal member flows into the dirty water cavity.

Embodiment 5

Figure 8:
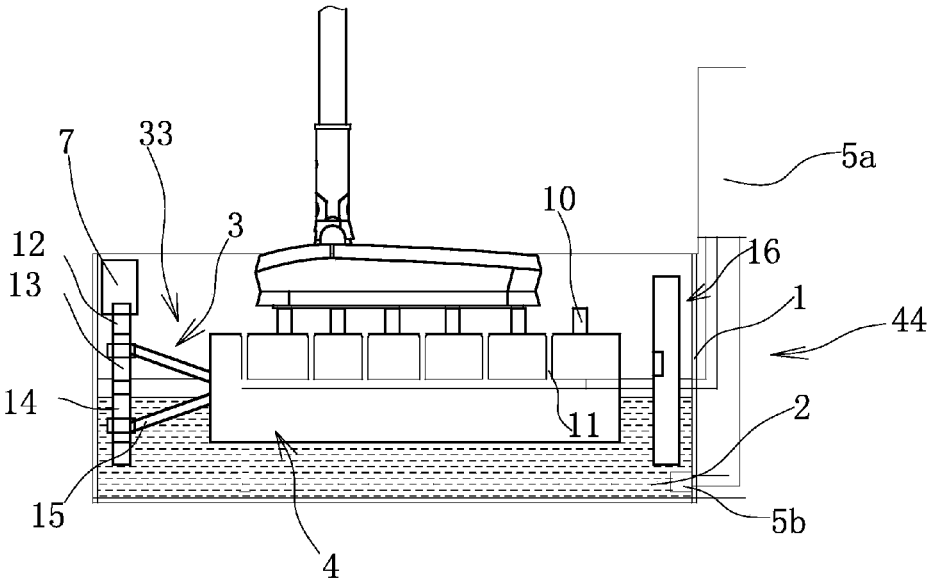
FIG. 8 is an overall structural view of Embodiment 5.

As shown in FIG. 8, in this embodiment, the bucket body 1 is provided with a water removal member 4 capable of reciprocating horizontally, and the water removal member 4 is connected to a driving mechanism 3 and is driven by the driving mechanism 3 to move; the cleaning device further comprises a water feeding mechanism 44 for conveying water to the water removal member 4 or a wiping object of a floor mopping machine; during cleaning, the water feeding mechanism 44 conveys water; and when water is removed, the water feeding mechanism 44 stops conveying water, and the wiping object of the floor mopping machine is wiped with the water removal member 4.

The cleaning device for a floor mopping machine comprises the water removal member 4 and the water feeding mechanism 44 for conveying water to the water removal member 4; when the cleaning device is used, the water feeding mechanism 44 conveys clean water to the water removal member 4, and then the water removal member 4 reciprocates horizontally to clean the wiping object and wipe away dirt on the surface of the wiping object; when the water feeding mechanism 44 stops conveying water, the water removal member 4 continues to reciprocate to wipe away water on the wiping object, so that the wiping object is wiped dry. The cleaning device has the advantages of being beneficial to cleaning and water removal. In this embodiment, the wiping object may be ultra-fiber cloth, rubber cotton, or sponge.

Preferably, the water feeding mechanism 44 may be a pump 5*b* or a water tank. When the pump 5*b* is used as the water feeding mechanism 44, the pump 5*b* pumps water to the water removal member 4 or the wiping object of the floor mopping machine, during cleaning. When the water tank is used as the water feeding mechanism 44, water in the water tank is guided to the water removal member 4 or the wiping object of the floor mopping machine through a water pipe connected to a water valve; and when the water valve is opened, water in the water tank flows to the water removal member 4 or the wiping object of the floor mopping machine.

Figure 9:
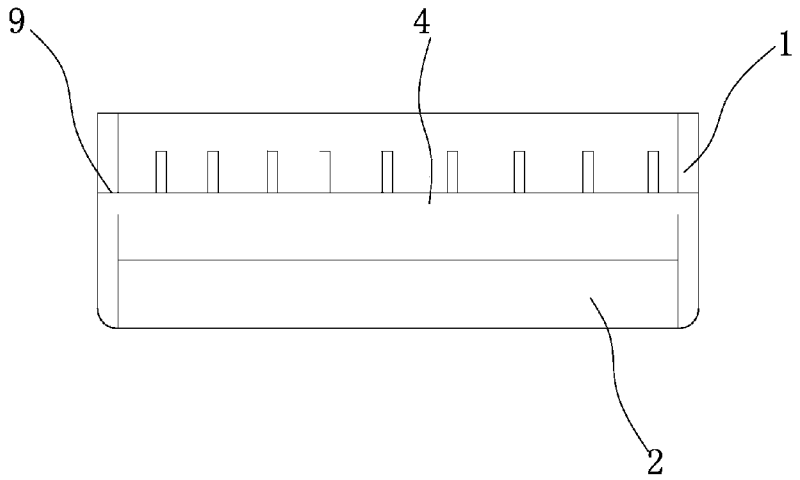
FIG. 9 is a partial structural view of FIG. 8.

Preferably, as shown in FIG. 9, a sliding groove 9, allowing the water removal member 4 to reciprocate horizontally, is formed in a position, corresponding to the water removal member 4, of the bucket body 1, and a side edge of the water removal member 4 is movably connected into the sliding groove 9. When the water removal member 4 reciprocates horizontally, the stability of the water removal member 4 is maintained through the sliding groove 9. To ensure that the water removal member 4 can slide smoothly, a wheel may be disposed at a position where the water removal member 4 contacts the sliding groove 9.

The water removal member 4 is any one or a combination of a strip, a brush and a roller.

A water outlet pipe 11 for spraying water to the wiping object is disposed in the water removal member 4, and a lower end of the water outlet pipe 11 is connected to the pump 5*b*. As shown in FIG. 8, the water outlet pipe 11 matched with the water removal member 4 and used for spraying water to the wiping object is disposed in the water removal member 4, the lower end of the water outlet pipe 11 is connected to the pump 5*b*, and the water outlet pipe 11 is spaced apart from the strips 10. The water removal member 4 is provided with the water outlet pipe 11 for spraying water, so that water can be sprayed more uniformly, and a better cleaning effect is realized.

In this embodiment, the driving mechanism 3 comprises a driver 7.

Preferably, a driving shaft 12 of the driver 7 is connected to a forward screw rod 13 and a reverse screw rod 14 which are coaxial with the driving shaft 12, and connecting rods for driving the water removal member 4 to move are connected to the forward screw rod 13 and the reverse screw rod 14; when the driver 7 drives the driving shaft 12 to rotate, the forward screw rod 13 and the reverse screw rod 14 rotate synchronously, the connecting rods 15 located at one end of the forward screw rod 13 and one end of the reverse screw rod 14 move close to or away from each other; when moving close to each other, the connecting rods 15 push the water removal member 4 to move away from the driver 7. When moving away from each other, the connecting rods 15 push the water removal member 4 to move close to the driver 7.

Embodiment 6

Figure 10:
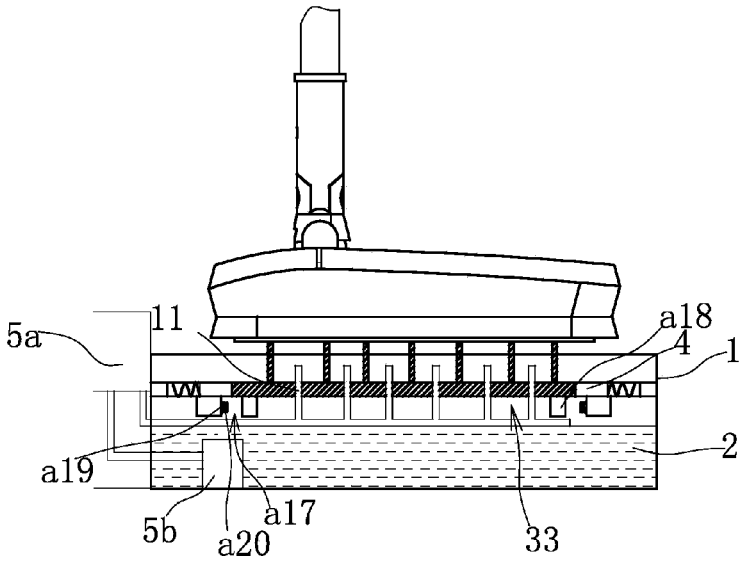
FIG. 10 is an overall structural view of Embodiment 6.

As shown in FIG. 10, the driving mechanism 3 comprises an attraction assembly a17 connected to the driving mechanism 3, and an electromagnetic induction member a18 matched with the attraction assembly a17 is disposed on the water removal member 4.

The attraction assembly a17 comprises a magnet disposed on the driver 7, and a coil wound on the magnet is electrically connected to the driver 7.

In this embodiment, an external power supply supplies power to the magnet, then the magnet provided with the coil will be magnetized to attract the electromagnetic induction member a18, and the water removal member 4 is driven to move towards the magnet; and when the current direction is changed, a magnetic pole of the end, close to the electromagnetic induction member a18, of the magnet will be opposite to a magnetic pole of the electromagnetic induction member a18, so the water removal member 4 is repelled to move away from the magnet. In this way, a reciprocating motion of the water removal member 4 is realized.

Preferably, the pump 5*b* pumps water from the bucket body 1. Or, the bucket body 1 comprises a dirty water cavity and a clean water cavity, and the pump 5*b* pumps water from the clean water cavity and then conveys the water to the water removal member 4 or the wiping object of the floor mopping machine; and dirt water removed by the water removal member 4 flows into the dirty water cavity.

Embodiment 7

Figure 11:
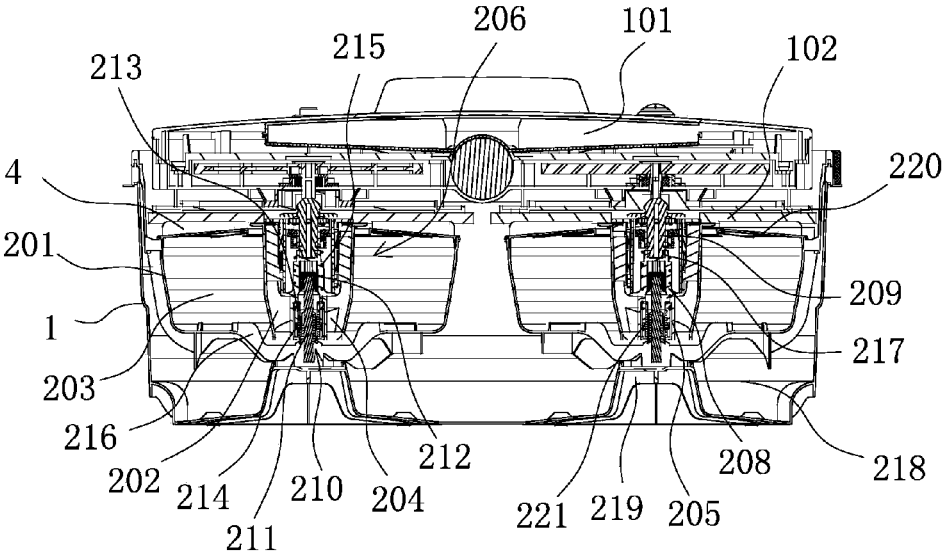
FIG. 11 is an internal structural view of Embodiment 7.

As shown in FIG. 11, in this embodiment, a floor mopping machine 101 is provided with a wiping object 102 for wiping floor; the cleaning device comprises a bucket body 1 and an inner bucket 201 disposed in the bucket body 1, wherein a water removal member 4 is disposed in the inner bucket 201, the wiping object 102 is matched with the water removal member 4, and a rotating impeller 204 for conveying water to the water removal member 4 is disposed in the inner bucket 201.

The floor mopping machine 101 is inserted into the bucket body 1, the wiping object 102 capable of rotating in a circumferential direction is connected to the bottom of the floor mopping machine 101, and cleaning water is contained in the inner bucket 201.

In this embodiment, the floor mopping machine 101 is inserted into the bucket body 1, and the wiping object 102 corresponds to the water removal member 4; when the wiping object 102 rotates forward, the rotating impeller 204 is driven by a connecting mechanism 206 to rotate to pump water from the inner bucket to the wiping object 102, so as to clean the wiping object; and when the wiping object 102 rotates reversely, the rotating impeller 204 stop conveying water, the wiping object is wiped dry by the water removal member 4 at the top of the bucket body 1.

According to the cleaning device, power for driving the wiping object of the floor mopping machine to rotate in the circumferential direction is used to automatically clean the wiping object and wipe the wiping object dry after the wiping object is cleaned; and clean water for cleaning and dirty water generated after cleaning can be separated through the inner bucket and the bucket body, so that the replacement frequency of cleaning water is decreased.

Those skilled in the art should understand that the connecting mechanism 206 may be directly connected to a rotating cylinder or a motor.

The water removal member 4 is any one or a combination of a strip, a brush and a roller.

The cleaning device for a floor mopping machine further comprises the connecting mechanism 206. The connecting mechanism 206 comprises a sleeve 208 disposed in the inner bucket 201, a connecting shaft 209 inserted into the sleeve 208 is disposed at the top of the sleeve 208, the top of the connecting shaft 209 can be clamped with the floor mopping machine 101, and the bottom of the sleeve 208 is connected to the rotating impeller 204.

In this embodiment, as shown in FIG. 11, the top of the connecting shaft 209 is inserted into the wiping object 102 and is clamped with the wiping object 102; when the wiping object 102 rotates, the connecting shaft 209 is driven to rotate to drive the sleeve 208 to rotate, which in turn drives the rotating impeller 204 to rotate to feed water.

A hexagon bolt slot 217 is formed in the sleeve 208, and the bottom of the connecting shaft 209 is inserted into the hexagon bolt slot 217.

In this embodiment, as shown in FIG. 11, the bottom of the connecting shaft 209 is inserted into the hexagon bolt slot 217 and drives the rotating impeller to feed water when the connecting shaft 209 rotates.

A transmission assembly 210 is disposed between the sleeve 208 and the rotating impeller 204. The transmission assembly 210 comprises a transmission shaft 211 inserted into the rotating impeller 204, the transmission shaft 211 is connected to a center shaft 205 of the rotating impeller 204, a clamping member 212 is disposed at the bottom of the sleeve 208, and the top of the transmission shaft 211 is inserted into the clamping member 212.

In this embodiment, as shown in FIG. 11, the sleeve 208 rotates to drive the transmission shaft 211 to rotate through the clamping member 212, and then the transmission shaft 211 drives the rotating impeller 204 to rotate to feed water.

The transmission shaft 211 is fixedly sleeved with a transmission sleeve 213, a transmission block 214 inserted into the center shaft 205 of the rotating impeller 204 is disposed on the transmission sleeve 213, and a disengaging portion 221 is disposed on the transmission block 214.

In this embodiment, as shown in FIG. 11, the transmission shaft 211 rotates to drive the transmission sleeve 213 to rotate, which in turn drives, through the transmission block 214, the rotating impeller 204 to rotate to feed water.

In addition, the disengaging portion 221 is an oblique step disposed at the top of the transmission block 214, and the transmission block 214 is clamped into a slot in the center shaft of the rotating impeller 204 when the connecting shaft 209 is pressed downwards, so that the transmission sleeve 213 is clamped with the center shaft of the rotating impeller 204.

A compression spring 215 is disposed at the bottom of the connecting shaft 209, and the bottom of the compression spring 215 is fixed in the center shaft of the rotating impeller 204.

In this embodiment, as shown in FIG. 11, when the top of the transmission shaft is not pressed, the compression spring 215 drives the connecting shaft 209, the sleeve 208, the transmission shaft 211 and the transmission block 214 to move upwards, and the transmission block 214 is disengaged from the slot in the center shaft of the rotating impeller 204 through the disengaging portion 221, and at this moment, water feeding is stopped without reversely rotating the wiping object, so that the cleaning device can be easily used by users.

An outer cavity 203 and an inner cavity 202 are formed in the inner bucket 201, the top of the inner cavity 202 penetrates through the inner bucket 201, a connecting passage 216 is disposed at the bottom of the inner cavity 202, and an end, away from the inner cavity 202, of the connecting passage 216 is connected to the bottom of the outer cavity 203.

In this embodiment, as shown in FIG. 11, when the rotating impeller 204 rotates forward, cleaning water in the outer cavity 203 is sucked into the inner cavity 202 through the connecting passage 216 and is then pumped out from the top of the inner cavity 202 to be conveyed to the wiping object 102.

The annular oblique step 220 is disposed on the inner bucket 201, water removal members 4 are disposed on the oblique step 220 and are fixedly connected to the oblique step 220, and the water removal members 4 are regularly arranged on the oblique step 220 in a circumferential direction.

In this embodiment, as shown in FIG. 11, the oblique step at the top of the inner bucket allows water, flowing out of the top of the inner cavity 202, to naturally flow down to the wiping object and prevents dirty water on the wiping object from flowing back into the inner bucket.

Moreover, the water removal members 4 are regularly disposed on the oblique step 220 in the circumferential direction, can clean the rotatable wiping object and wipe the rotatable wiping object thy, and can improve the cleaning and wipe-drying efficiency.

The operating principle of the invention is as follows: the floor mopping machine 101 is inserted into the bucket body 1, the top of the connecting shaft 209 is inserted into the wiping object 102 and is clamped with the wiping object 102, and the wiping object is pressed downwards to enable the transmission block 214 to be clamped into the slot in the center shaft of the rotating impeller 204, so that the transmission sleeve 213 is clamped with the center shaft of the rotating impeller 204; when the wiping object 102 rotates, the connecting shaft 209 is driven to rotate to drive the sleeve 208 to rotate, which in turn drives the transmission shaft 211 to rotate through the clamping member 212 so as to drive the transmission sleeve 213 to rotate, then the transmission sleeve 213 drives, through the transmission block 214, the rotating impeller 204 to feed water, and at this moment, the wiping object rotates to be cleaned by the water removal member 4; when the floor mopping machine 101 is released, the compression spring 215 drives the connecting shaft 209, the sleeve 208, the transmission shaft 211 and the transmission block 214 to move upwards, the transmission block 214 is disengaged from the slot in the center shaft of the rotating impeller 204 through the disengaging portion 221, and at this moment, the wiping object rotates to be wiped dry by the water removal member 4. According to the cleaning device, power for driving the wiping object of the floor mopping machine 101 to rotate in a circumferential direction is used to automatically clean the wiping object and wipe the wiping object dry after the wiping object is cleaned, and clean water for cleaning and dirty water generated after cleaning are separated through the inner bucket and the bucket body, so that the replacement frequency of cleaning water is decreased, and water resources are saved.

Embodiment 8

Figure 12:
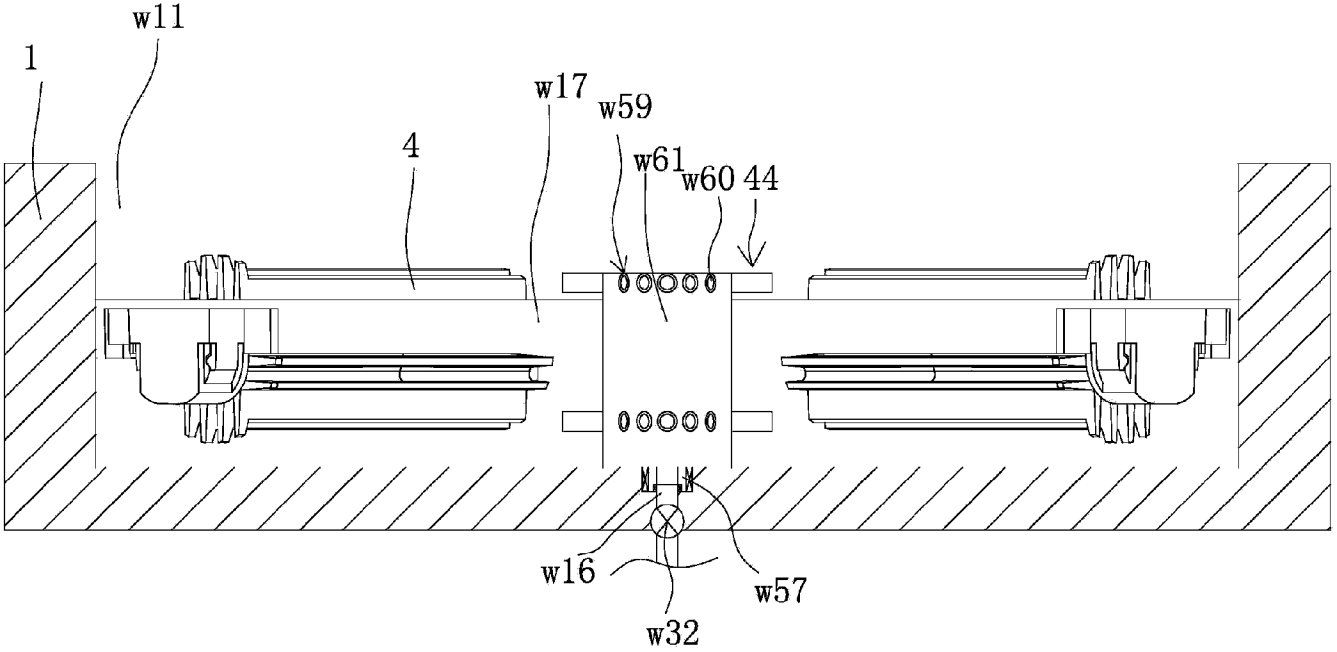
FIG. 12 is an overall structural view of Embodiment 8.

As shown in FIG. 12, in this embodiment, water removal members 4 capable of rotating around center lines of their own are disposed in the bucket body 1, and the water removal members 4 are able to scrape with a wiping object of a floor mopping machine; the bucket body 1 is connected to a water feeding mechanism 44 for conveying water to the wiping object of the floor mopping machine; and when the wiping object is cleaned with water, the water feeding mechanism conveys water to the wiping object of the floor mopping machine. Preferably, when the water feeding mechanism conveys water to the wiping object to clean the wiping object, the water removal members 4 scrape with the wiping object of the floor mopping machine, so that the cleaning effect is improved.

In this embodiment, the bucket body 1 is used for containing clean water; when the wiping object is cleaned, water gushes into the bucket body 1 from the bottom of the bucket body 1 through the water feeding mechanism 44. Preferably, the water feeding mechanism 44 is a water pump, which can pump water therein and then sprays the water out to wash the wiping object. The wiping object is pressed against the water removal members 4, at this moment, the water removal members 4 are driven by an external force to rotate or the wiping object moves, so that the wiping object is cleaned by the water removal members; when the wiping object is completely cleaned, the water feeding mechanism 44 stops conveying water, so the wiping object is no longer cleaned with water and is still pressed against the water removal members 4, at this moment, the water removal members are driven by an external force to rotate to scrape and squeeze the wiping object, water left in the wiping object is squeezed out, and water removal of the wiping object is completely.

The water removal members 4 are any one or a combination of strips and rollers, so that the diversity of the cleaning device is improved.

Preferably, when water is removed, the water feeding mechanism 44 stops conveying water to the wiping object, water removal members 4 keep static, and the wiping object of the floor mopping machine moves and scrapes with the water removal members 4, so that water on the wiping object is removed. According to another preferred implementation, the water removal members 4 are driven by a motor w40 and scrape with the wiping object of the floor mopping machine. In this solution, the water removal members 4 are powered to move to remove water from the wiping object.

According to another implementation of the water feeding mechanism 44, the water feeding mechanism 44 comprises a bucket body 1, the bucket body 1 is connected to a water inlet pipe w16 for conveying cleaning water to the wiping object, and the bottom of the bucket body 1 is higher than a water outlet of the water inlet pipe w16. Water automatically flows to the wiping object through the water feeding mechanism 44.

According to another implementation of the water feeding mechanism 44, the water feeding mechanism 44 comprises a water inlet pipe w16 disposed at the bottom of the bucket body 1, and the water inlet pipe w16 is connected to a cleaning cavity w11 and conveys water from the bottom of the bucket body 1 into the cleaning cavity w11.

The water feeding mechanism 44 further comprises the water inlet pipe w16 disposed at the bottom of the bucket body 1, an end, close to the bottom of the bucket body 1, of the water inlet pipe w16 is connected to a connecting pipe w57, and an end, away from the water inlet pipe w16, of the connecting pipe w57 is connected to a water sprayer w61 disposed in the bucket body 1.

In this embodiment, during cleaning, external cleaning water flows upwards into the bucket body 1 from the bottom of the bucket body 1 through the water inlet pipe w16, then flows into the water sprayer w61 through the water inlet pipe w16, and finally is sprayed out of the water sprayer w61 to wash the wiping object.

The water inlet pipe w16 is rotatably connected to the connecting pipe w57, and the connecting pipe w57 is rotatably connected to the bucket body 1.

During the water spraying process, water under high pressure is sprayed out of the water sprayer w16 to clean the wiping object; because the water inlet pipe w16 is hinged to the connecting pipe w57 and the connecting pipe w57 is hinged to the bucket body 1, a reactive force generated when water impacts the wiping object will be applied to the water sprayer w61 to make the water sprayer w61 to rotate, and water sprayed out of the water sprayer w61 is sprayed to the wiping object to clean the wiping object while rotating with the water inlet pipe w16.

Upper and lower nozzle layers w59 are connected to the water sprayer w61, the upper nozzle layer w59 is located on the same horizontal plane as the top of a plurality of water removal members 4, and the lower nozzle layer w59 is located on the same horizontal plane as the bottom of the plurality of water removal members 4.

Each nozzle layer w59 comprises a plurality of nozzles w60, and the plurality of nozzles w60 on each nozzle layer w59 are distributed at equal intervals in a radial direction of the water sprayer w61.

In the cleaning process, water is sprayed out via the plurality of nozzles w60 on the two nozzle layers w59; the nozzles w60 are distributed on the upper layer and the lower layer, the upper and lower nozzle layers w59 are located on the same horizontal plane as the top and the bottom of the plurality of water removal members 4 respectively, water sprayed out of the upper nozzle layer w59 is used to clean the wiping object, water sprayed out of the lower nozzle layer w59 is used to wash the water removal members 4 to remove impurities from the water removal members 4; and the plurality of nozzles w60 on each nozzle layer w59 are distributed at equal intervals in the radial direction of the water sprayer w61, so that water can be uniformly sprayed onto the wiping object.

A wiper frame w17 is movably connected into the bucket body 1, the plurality of water removal members 4 capable of rotating around center lines of their own in the circumferential direction are hinged into the wiper frame w17, and the water sprayer w61 penetrate through the wiper frame w17 and is rotatably connected to the wiper frame w17.

Figure 13:
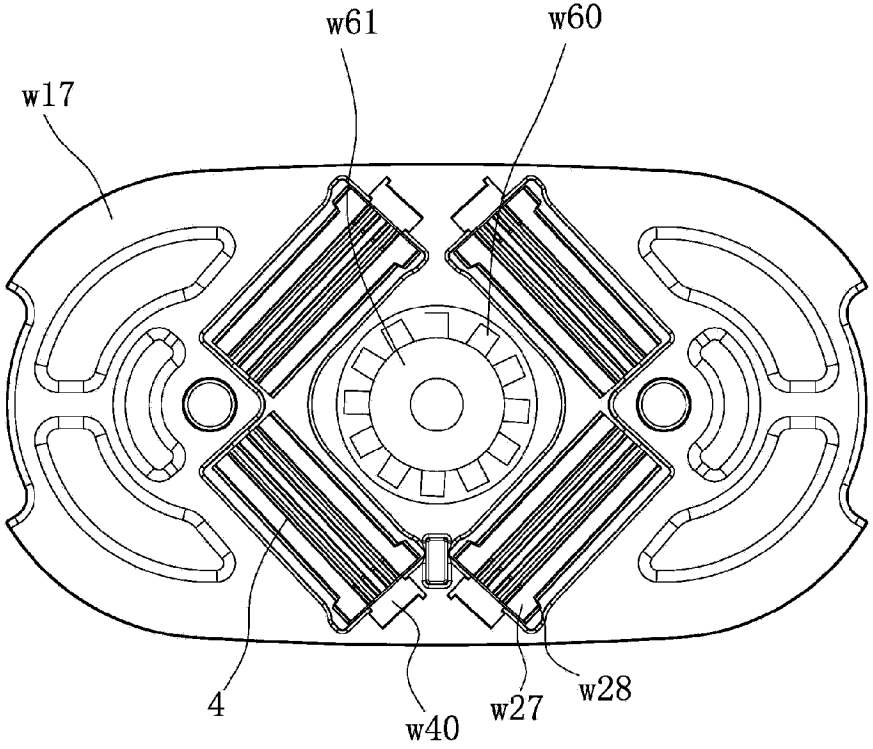
FIG. 13 is a top view of a wiper frame in Embodiment 8.

As shown in FIG. 13, one implementation of the wiper frame is as follows: a plurality of motors w40 are disposed in the wiper frame w17 and are in one-to-one correspondence with the plurality of water removal members 4, and output shafts of the motors w40 are connected to the corresponding water removal members 4.

The motors w40 work to drive the water removal members 4 to rotate to clean the wiping object and then wipe water away from the wiping object.

Figure 14:
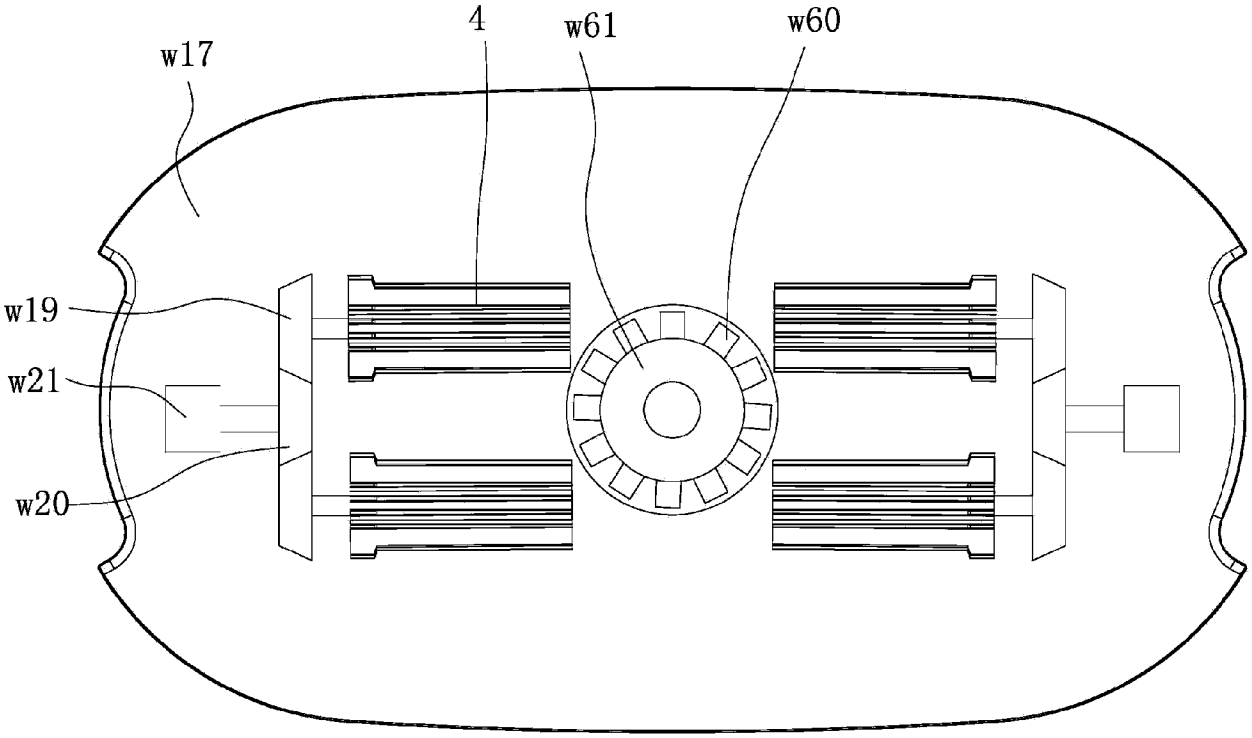
FIG. 14 is a top view of another wiper frame in Embodiment 8.
Figure 15:
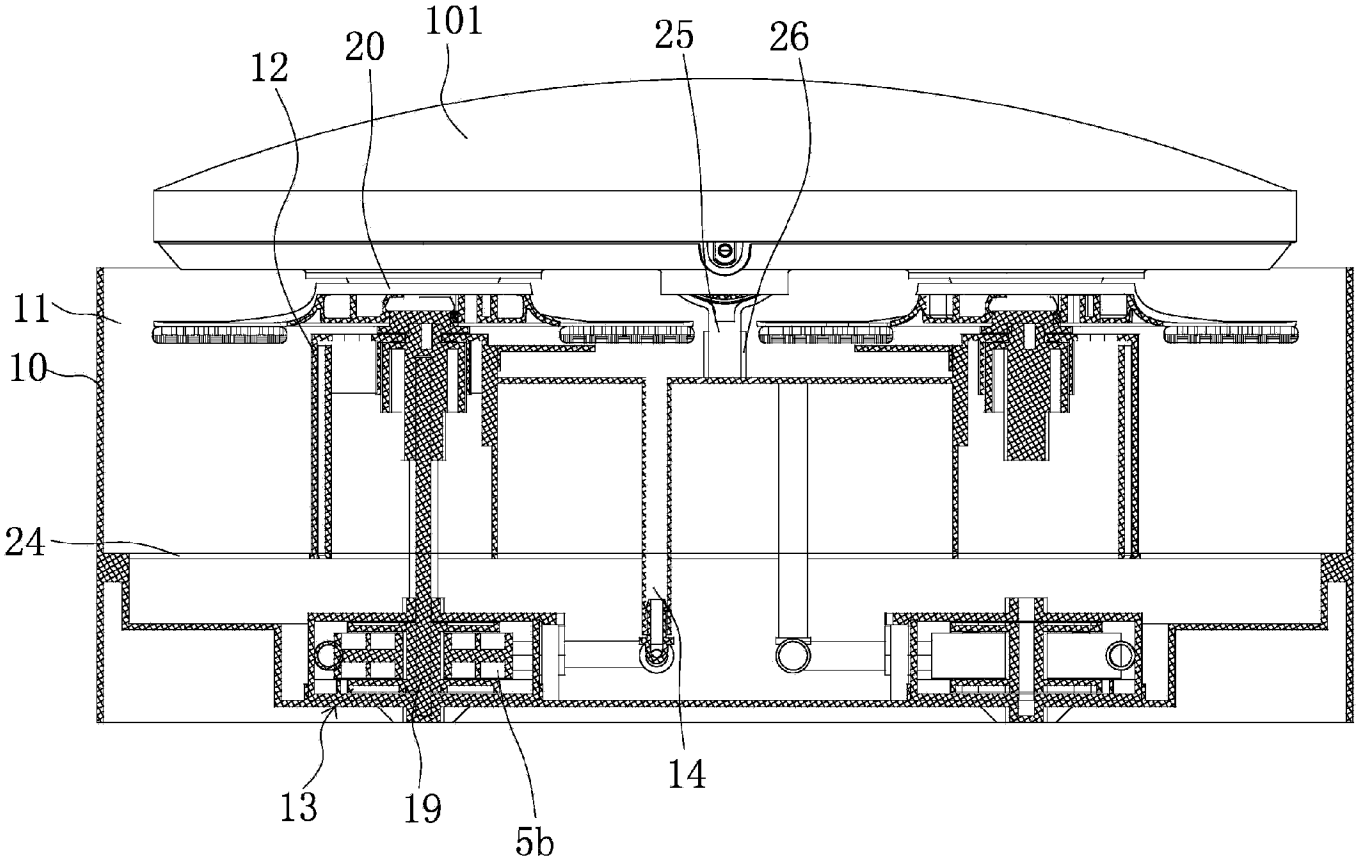
FIG. 15 is an overall structural view of Embodiment 9.
Figure 16:
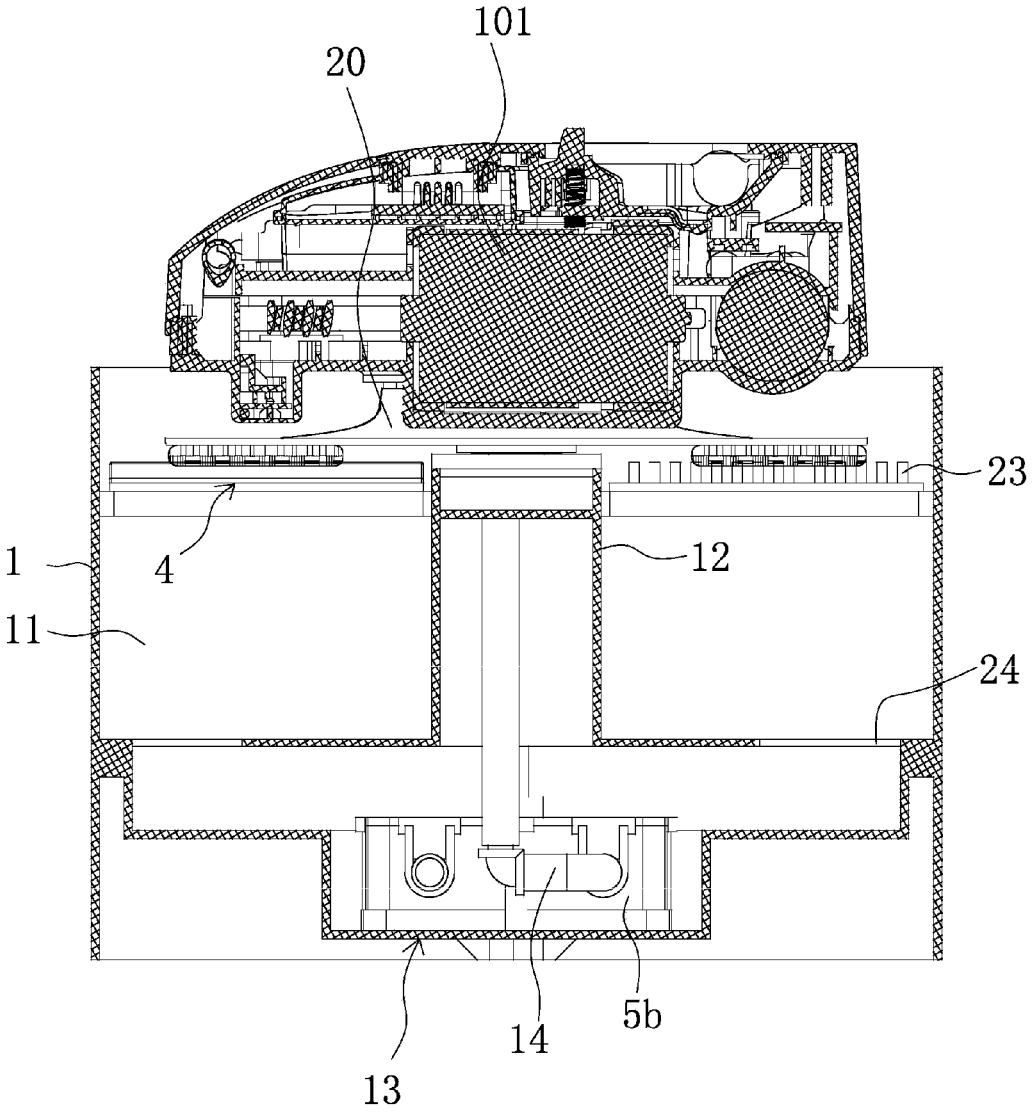
FIG. 16 is a schematic diagram of FIG. 15 in another direction.
Figure 17:
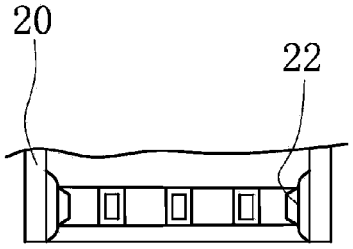
FIG. 17 is a structural view of clamping grooves in the top end of an input shaft in Embodiment 9.
Figure 18:
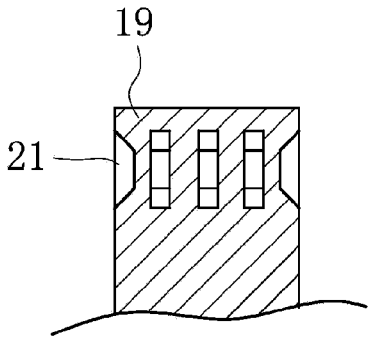
FIG. 18 is a structural diagram of buckles on a wiping object in Embodiment 9

As shown in FIG. 14, another implementation of the wiper frame is as follows: a driven gear w19 is disposed at the end of each water removal member 4, a plurality of driving gears w20 are disposed on the wiper frame w17, each driving gear w20 corresponds to at least two water removal members 4 and is engaged and connected with at least two driven gears w19, and each driving gear w20 is connected to a rotating motor w21.

In this embodiment, each driving gear w20 is engaged with two corresponding driven gears w19 and synchronously drives two water removal members 4 to rotate when rotating; the wiping object is placed on and pressed against the wiper frame w17, and then the water removal members 4 squeeze the wiping object; when the wiping object is cleaned, the water sprayer w61 sprays water to wash the wiping object, and each working gear 12 rotates to drive two water removal members 4 to rotate to squeeze the wiping object for cleaning; and when the wiping object is thoroughly cleaned, the working gears 12 rotate to drive the water removal members 4 to rotate to squeeze the wiping object in absence of water, so that water on the wiping object is wiped away.

Embodiment 9

As shown in FIG. 15-FIG. 20, in this embodiment, a cleaning cavity 11 is formed in a bucket body 1, at least one water feeding mechanism 44 for spraying water upwards out from the bottom of the cleaning cavity 11 is disposed at the bottom of the cleaning cavity 11, and a water removal member 4 located in the cleaning cavity 11 is disposed above the water feeding mechanism 44.

In the invention, the water feeding mechanism 44 sprays water upward to a wiping object from bottom to wet and wash the wiping object; after being wetted, the wiping object abuts against and contacts with the water removal member 4, so when the water removal member 4 or the wiping object rotates, the water removal member 4 presses against the wiping object to squeeze water out of the wiping object, so that the wiping object is wiped dry.

The water feeding mechanism 44 comprises a pump 5*b*, an outlet of the pump 5*b* is located in the bottom of the cleaning cavity 11 and is connected to a water outlet pipe 14, and the water outlet pipe 14 extends upwards to the water removal member 4.

In the invention, when the pump 5*b* rotates reversely, an inlet and the outlet of the pump 5*b* are exchanged. When the wiping object is cleaned, a water outlet of the water outlet pipe 14 is located below the wiping object, the pump 5*b* works to spray water from the cleaning cavity 11 upward to the wiping object through the water outlet pipe 14, and at this moment, the wiping object is rotated to be thoroughly cleaned.

The pump 5*b* is one of a gear pump, an impeller pump and an electric pump.

Figure 19:
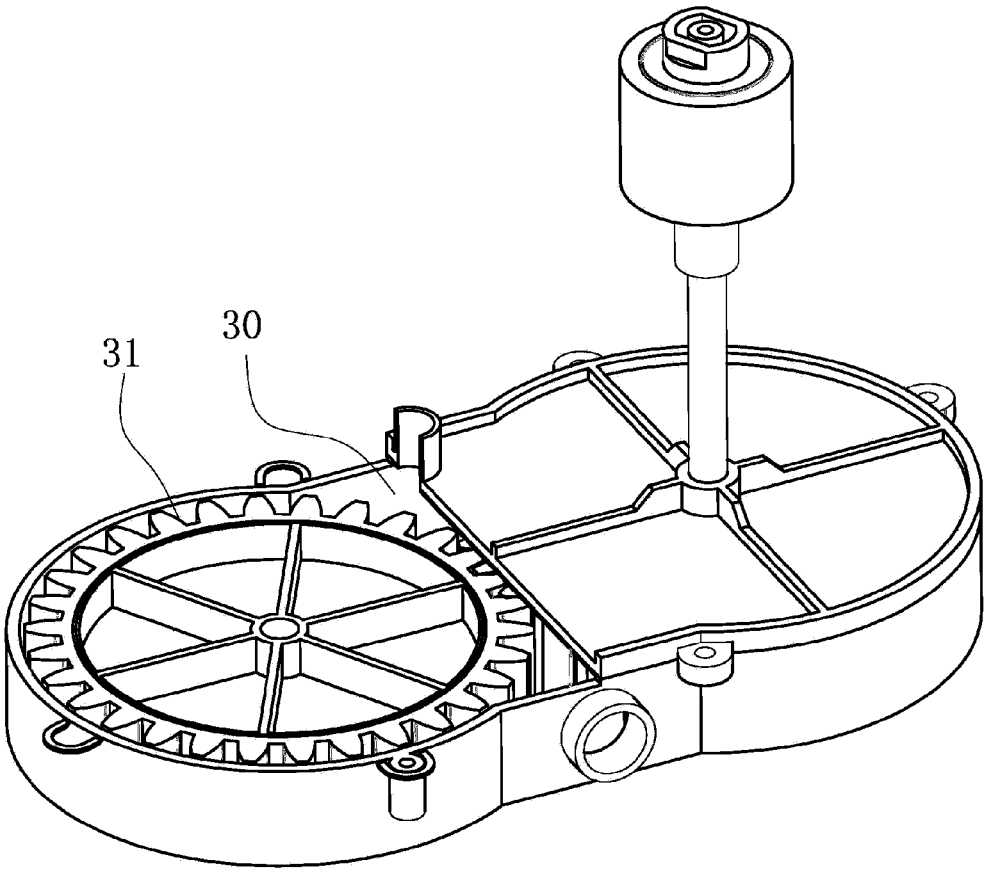
FIG. 19 is a schematic diagram of one implementation of a pump in Embodiment 9.

As shown in FIG. 19, the pump 5*b* is a gear pump, a gear pump working chamber 30 is formed in the gear pump, two gears 31 engaged with each other are rotatably connected into the gear pump working chamber 30, and a water inlet and a water outlet of the gear pump are located in two sides of a position where the two gears 31 are engaged with each other, respectively. When the gears 31 rotate at a high speed, water is sucked into the gear pump via the water inlet and is squeezed out via the water outlet.

Figure 20:
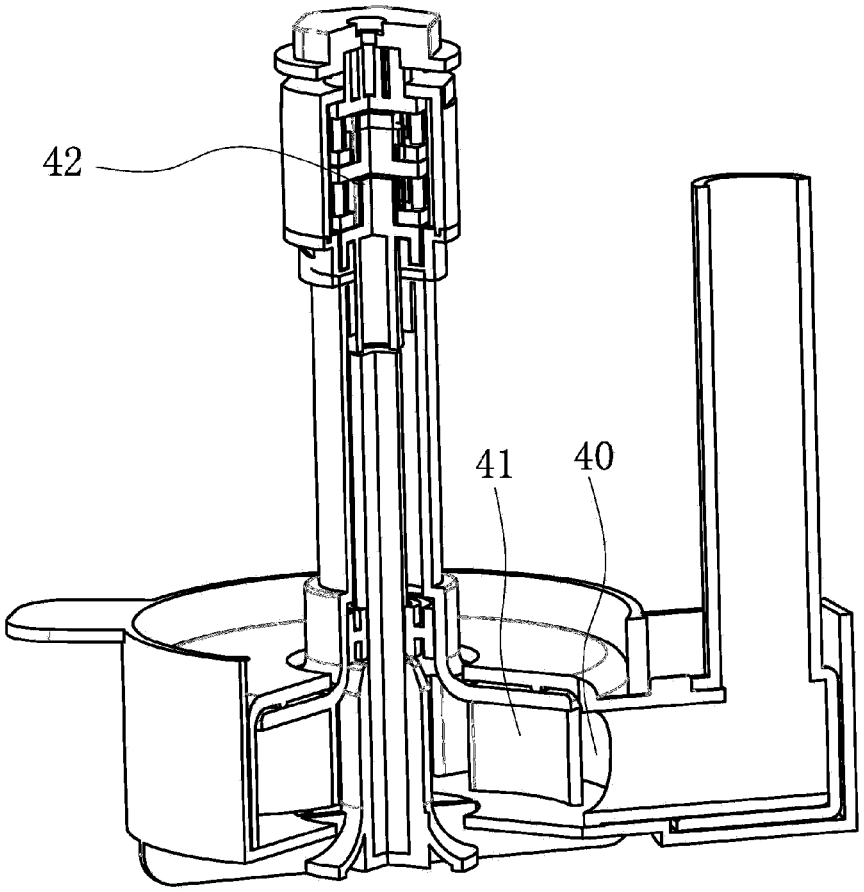
FIG. 20 is a schematic diagram of another implementation of the pump in Embodiment 9.

As shown in FIG. 20, the pump 5*b* is an impeller pump, an impeller pump working chamber 40 is formed in the impeller pump, an impeller 41 is rotatably connected into the impeller pump working chamber 40, and a water inlet and a water outlet of the impeller pump are located in two sides of the impeller 41 respectively. When the impeller 41 rotates at a high speed, water is sucked into the impeller pump via the water inlet and is squeezed out via the water outlet. An acceleration gearbox 42 is connected to the impeller 41, and the acceleration gearbox 42 is a mechanism for increasing the rotation speed of the impeller 41 by means of transmission between gears.

The pump 5*b* is an electronic pump which is uses a piezoelectric material as a power device, and is a novel water pump which realizes complete electronic operation from control to driving, controls liquid transfer by means of an electronic integration system, and realizes controllable and accurate liquid transfer. The motor uses the piezoelectric material as the power device in the driving mode, changes traditional motor driving, can convey liquid accurately, and can be used in the fields of quantitative liquid transfer, quantitative control and the like.

The water removal member 4 is a cleaning frame 12 disposed at the top of the cleaning cavity 11, and the water removal member 4 is any one or a combination of a scraper, a strip, or a disk with protrusions.

In the invention, the wiping object is placed on the cleaning frame 12 and abuts against the water removal member 4; when the wiping object is rotated forward, the water outlet pipe 14 sprays water upwards to wet the wiping object; after being wetted, the wiping object rotates forward to contact with the water removal member 4, and the water removal member 4 slides with respect to the wiping object to remove dirt from the wiping object, so that the wiping object is cleaned; after being cleaned, the wiping object continues to rotate to contact with the water removal member 4 again, and at this moment, the water removal member 4 pushes the wetted wiping object, so that water on the wiping object is wiped away by the water removal member 4 with the rotation of the wiping object. The wiping object is cleaned repeatedly in this way.

The cleaning device further comprises a floor mopping machine 101, a mop disk rotatably connected to the floor mopping machine 102 and corresponding to the water feeding mechanism 44 is disposed at the bottom of the floor mopping machine 101, the pump is connected to an input shaft 19, and the input shaft 10 extends upwards and is detachably connected to the corresponding mop disk 20.

In the invention, the wiping object is disposed on the mop disk 20. When the wiping object is cleaned, the floor moping machine 101 is placed on the cleaning frame 12 and the mop disk 20 is clamped with the input shaft 19; when the mop disk 20 rotates forward, the input shaft 10 clamped with the mop disk 20 rotates forward synchronously to drive the pump to rotate forward, so that water is pumped into the pump 5*b* from the cleaning cavity 11 and is then sprayed upwards through the water outlet pipe 14 to wet the wiping object; and when the mop disk 20 rotates reversely, the input shaft 10 drives the pump 5*b* to rotate reversely to guide air into the cleaning cavity 11, and water is prevented from being sprayed out of the cleaning cavity 11. The mop disk 20 is connected to a rotating motor disposed in the floor mopping machine 101, and the rotating motor works to drive the mop disk 20 to rotate.

A plurality of clamping grooves 21 distributed in a ring array are formed in the top of the input shaft 19, a plurality of deformable buckles 22 in one-to-one correspondence with the clamping grooves 21 are disposed in the mop disk 20, and the buckles 22 can extend to be clamped into the corresponding clamping grooves 21.

In the invention, when the floor mopping machine 101 is placed on the cleaning frame 12, the buckles 22 are squeezed by the end of the input shaft 10 and will deform; and when the buckles 22 extend into the clamping grooves 21, the buckles 22 restore to the initial state and are clamped in the clamping grooves 21.

The cross-section of the clamping grooves 21 in the vertical direction is in the shape of an isosceles trapezoid, upper and lower inner walls of each clamping groove 21 are opposite to each other and are sloping, and the buckles 22 are matched with the clamping grooves 21.

In the invention, similar to the upper and lower inner walls of each clamping groove, upper and lower end faces of each buckle are sloping; when the buckles 22 are pushed into the clamping grooves 21, the end of the input shaft 19 squeezes the slopping faces of the buckles to enable the buckles to deform until the buckles extend into the clamping grooves; and when the floor mopping machine 101 is lifted after the wiping object is cleaned, the buckles 22 will deform under the action of the sloping faces of the clamping grooves until the buckles are removed out of the clamping grooves 21, and other end faces of the buckles 22 are all straight.

Two individual mop disks 20 are disposed at the bottom of the floor mopping machine 101.

In the invention, two opposite mop disks 20 are disposed at the bottom of the floor mopping machine 101, and when the wiping object is cleaned or the floor mopping machine is used for mopping floor, the two mop disks 20 rotate separately.

A filter screen 24 is disposed above the water feeding mechanism 44 and is arranged along an inner wall of the cleaning cavity 11, and the water outlet pipe 14 penetrates upwards through the filter screen 24.

In the invention, dirt enters the cleaning cavity 11 in the cleaning process, and will be blocked by the filter screen 24 when water is pumped by the pump 5*b*, so that the dirt is prevented from entering the pump 5*b*, which may otherwise cause damage to the pump 5*b*.

An abutting block 25 extending downwards is disposed at the bottom of the floor mopping machine 101, and the mop disks 20 are located on two sides of the abutting block 25; when the abutting block 25 abuts against the cleaning frame 12, the mop disks 20 are clamped with the input shaft 19; and gaps are reserved between the mop disks 20 and the cleaning frame 12.

In the invention, the wiping object only contacts with the water removal member 4 in the cleaning process.

A placement locating groove 26 matched with the abutting block 25 is formed in the cleaning frame 12.

In the invention, by accurately placing the abutting block 25 on the floor mopping machine 101 in the placement locating groove 26, the floor mopping machine 101 can be aligned and clamped with the input shaft 19, and the floor mopping machine 101 can be restrained from moving in the rotating process, so that the stability is improved.

The operating principle of the invention is as follows: the abutting block 25 on the floor mopping machine 101 is accurately placed in the placement locating groove 26, so that the floor mopping machine 101 is aligned and clamped with the input shaft 19, and the wiping object on the mop disks 20 abuts against the water removal member 4; when the mop disks 20 rotate forward, the input shaft 10 clamped with the mop disks 20 rotates forward synchronously to drive the pump 5*b* to rotate forward, so that water is pumped into the pump 5*b* from the cleaning cavity 11 and is then sprayed upwards through the water outlet pipe 14 to wet the wiping object; after being wetted, the wiping object rotates forward to contact with the water removal member 4, and the water removal member 4 slides with respect to the wiping object to remove dirt from the wiping object, so that the wiping object is cleaned; after being cleaned, the wiping object continues to rotate to contact with the water removal member 4 again, and at this moment, the water removal member 4 pushes the wetted wiping object, so that water on the wiping object is wiped away by the water removal member 4 with the rotation of the wiping object. The wiping object is cleaned repeatedly in this way.

The specific embodiments described in this specification are merely used to explain the spirit of the invention by way of examples. Those skilled in the art may make various amendments, supplements or similar substitutions to these specific embodiments described above without departing from the spirit of the invention or exceeding the scope defined by the appended claims.

What is claimed is:

1. A cleaning device for a floor mopping machine, comprising:

a bucket body, wherein a water removal member is disposed in the bucket body; and a water feeding mechanism for conveying water to a wiping object of the floor mopping machine;

the water feeding mechanism configured to convey water during cleaning;

wherein the water feeding mechanism comprises a roller rotatably connected to the bucket body;

when the roller rotates in a first direction, cleaning water is conveyed to the floor mopping machine;

when the roller rotates in a second direction, the roller is clamped in a clamping groove and stopped from rotating; and when water is to be removed, the water feeding mechanism stops conveying water, and the wiping object of the floor mopping machine is wiped with the water removal member.

2. The cleaning device according to claim 1, wherein the bucket body comprises a dirty water cavity and a clean water cavity, and the water feeding mechanism conveys water from the clean water cavity to the wiping object of the floor mopping machine; and dirty water removed by the water removal member flows into the dirty water cavity.

3. The cleaning device according to claim 1, wherein the roller is driven to move horizontally toward the clamping groove.

4. The cleaning device according to claim 1, wherein the water feeding mechanism comprises at least one strip of the roller.

5. The cleaning device according to claim 1, wherein the water removal member is configured to rotate around a center line of the roller.

6. The cleaning device according to claim 1, wherein the water feeding mechanism and a driving mechanism for driving the water feeding mechanism to rotate with respect to the bucket body are disposed in the bucket body.

* * * * *